US005543109A

United States Patent [19]

Senba et al.

[11] Patent Number: 5,543,109

[45] Date of Patent: Aug. 6, 1996

[54] HEAT RESISTANT HIGH CHROMIUM AUSTENITIC ALLOY EXCELLENT IN STRENGTH AT ELEVATED TEMPERATURES

[75] Inventors: Hiroyuki Senba; Yoshiatsu Sawaragi, both of Nishinomiya, Japan

[73] Assignee: Sumitomo Metal Industries, Ltd., Osaka, Japan

[21] Appl. No.: 381,419

[22] Filed: Jan. 31, 1995

[30] Foreign Application Priority Data

Jan. 31, 1994 [JP] Japan ..... 6-009366

[51] Int. Cl.[6] ..... C22C 19/00

[52] U.S. Cl. ..... 420/446; 420/447; 420/448; 420/449; 420/588; 148/428; 148/442

[58] Field of Search ..... 420/442, 443, 420/446, 447, 448, 449, 584, 588; 148/428, 442

[56] References Cited

U.S. PATENT DOCUMENTS 5,021,215 6/1991 Sawaragi et al. ..... 420/442

*Primary Examiner*—Sikyin Ip

*Attorney, Agent, or Firm*—Burns, Doane, Swecker & Mathis, L.L.P.

[57] ABSTRACT

A high Cr austenitic heat resistant alloy excellent in high temperature strength which essentially consists of, in weight percent, from more than 0.02% to 0.10% C, not more than 1.0% Si, not more than 2.0% Mn, 28 to 38% Cr, 35 to 60% Ni, from more than 0.5% to 1.5% Ti, not more than 0.05% N, 0.01 to 0.3% Al, 0.001 to 0.01% B, 0 to 0.1% Zr, 0 to 1.0% Nb, one or both of 0.5 to 3.0% Mo and 1.0 to 6.0% W, and the balance being Fe and incidental impurities. The alloy may further contain one or both of 0.001 to 0.05% Mg and 0.001 to 0.05% Ca. This alloy is suitable for producing a single layered tube which is less expensive and more reliable than the conventional double layered tube.

7 Claims, 1 Drawing Sheet

NOTE:

(1) NUMERIC VALUE IN EACH CIRCLE SHOWS CREEP RUPTURE STRENGTH AT 700°C FOR 1000 HR.

(2) THE CIRCLE'S SUBSCRIPT REFERS TO SPECIMEN NOS. LISTED IN TABLES 1 TO 3.

NOTE:
(1) NUMERIC VALUE IN EACH CIRCLE SHOWS CREEP RUPTURE STRENGTH AT 700°C FOR 1000 HR.
(2) THE CIRCLE'S SUBSCRIPT REFERS TO SPECIMEN NOS. LISTED IN TABLES 1 TO 3.

HEAT RESISTANT HIGH CHROMIUM AUSTENITIC ALLOY EXCELLENT IN STRENGTH AT ELEVATED TEMPERATURES

FIELD OF THE INVENTION

This invention relates to a heat resistant high chromium austenitic alloy which is excellent in strength at high temperatures and suitable for materials of boilers, chemical plants and other apparatus which are exposed to severely high temperature environments at work.

BACKGROUND OF THE INVENTION

In recent years, super high temperature and high pressure boilers have attracted public attention in the field of power plants because of improved high heat efficiency. Since these boilers make steam of higher temperature and pressure compared with the conventional boilers, materials for tubes such as superheater tubes in these boilers must satisfy various requirements, relating to high temperature strength and corrosion resistance that are far more severe than that of conventional boilers. For these purposes, development of an alloy with excellent high temperature strength and high temperature corrosion resistance, particularly resistance to steam oxidizing, compared with the conventional 18–8 stainless steel, has been strongly desired.

It is generally known that increasing of the Cr content is effective to improve corrosion resistance of steel. However, the strength at temperatures of 600° to 700° C. of steel containing about 25% Cr, such as SUS STB310 Steel (according to Japanese Industrial Standards), is lower than that of the 18–8 stainless steel. Another problem is that toughness of high Cr stainless steel containing about 25% Cr is reduced by σ-phase precipitation during service and corrosion resistance is not sufficient in severely corrosive environments.

A heat resistant steel containing a higher level of Cr, i.e. 20% to 20% of Cr, and exhibiting relatively high corrosion resistance is disclosed in Japanese Patent Public Disclosure 59-153858 (JPPD 59-153858). This heat resistant steel, however, does not have enough high temperature strength to be used as a single layered tube in the above-mentioned severe environments. Although this steel can be used for one of the layers in a double layered tube, i.e. clad-tube, in combination with a high strength alloy, such double layered tubes are very expensive to produce and not always reliable for use in actual plants.

There are other types of heat resistant alloys containing about 30% Cr which also contain Mo and W for increasing the strength, as disclosed in JPPD 60-100620, JPPD 61-172350, JPPD 61-276928 and JPPD 62-55352. High temperature strength of these heat resistant alloys, however, is not sufficient.

SUMMARY OF THE INVENTION

The object of this invention is to provide a heat resistant high Cr austenitic alloy having high strength and excellent corrosion resistance in high temperature corrosive environments.

A heat resistant alloy of this invention is described as follows:

(1) A heat resistant high chromium austenitic alloy excellent in high temperature strength consisting essentially of, in weight percent, from more than 0.02% to 0.10% C, not more than 1.0% Si, not more than 2.0% Mn, 28 to 38% Cr, 35 to 60% Ni, from more than 0.5% to 1.5% Ti, not more than 0.05% N, 0.01 to 0.3% Al, 0.001 to 0.01% B, 0 to 0.1% Zr, 0 to 1.0% Nb, one or both of 0.5 to 3.0% Mo and 1.0 to 6.0% W, and the balance being Fe and incidental impurities.

(2) A heat resistant high chromium austenitic alloy containing one or both of 0.001 to 0.05% Mg and 0.001 to 0.05% Ca, in weight percent, in addition to the above-mentioned elements.

The preferable Zr content and Nb content, if they are contained in the alloy, are 0.01 to 0.1% and 0.10 to 1.0% respectively, in weight percent.

In order to obtain sufficient corrosion resistance in severe corrosive environments at elevated temperatures, more than 28% of Cr content is necessary. In the matrix of the Cr—Ni—Fe system alloy containing such a high Cr amount and a particular amount of Ni, α-Cr phase, i.e. a Cr-rich body centered cubic crystal, precipitates. The precipitated α-Cr phase imparts higher strength to the alloy.

DETAILED DESCRIPTION OF THE INVENTION

Figure 1:
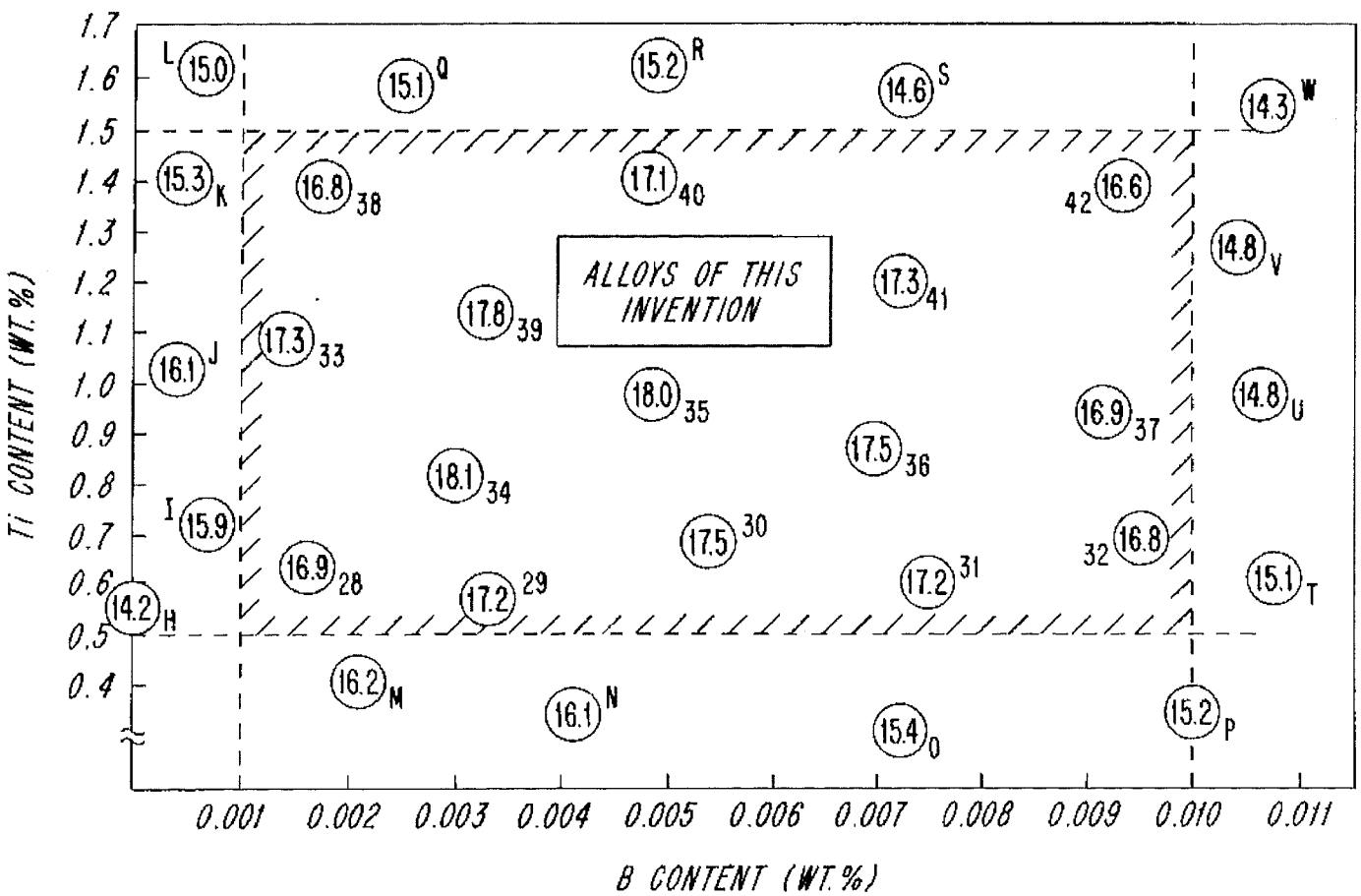
FIG. 1 shows influences of Ti and B content on creep rupture strength of austenitic heat resistant alloys.

The inventors have conducted various studies with a view to remarkably improving creep rupture strength of high Cr austenitic alloys, and have obtained the following findings.

[1] Addition of Ti to the austenitic alloy greatly improves its creep rupture strength, due to the fact that the Ti accelerates precipitation of the α-Cr phase which is a Cr-rich body centered cubic phase.

[2] Addition of B in combination with Ti to the austenitic alloy remarkably improves its creep rupture strength, due to the fact that B accelerates precipitation of fine and stabilized carbides which greatly increase the strength of the alloy at high temperatures and suppress a grain growth and coarsening of the α-Cr phase during long periods of use.

[3] Addition of both B and Ti imparts to the austenitic alloy a high temperature strength much higher than that of the heat resistant alloys disclosed in the foregoing JPPD 60-100620 and others.

The behavior and function of each alloying element which altogether constitutes the alloy of this invention will be described in more detail as well as the technical reasons for restricting the content of each said alloying element, wherein "%" represents percent by weight.

C: from more than 0.02% to 0.10%

C forms carbides and effectively improves tensile strength and creep rupture strength which are necessary for the heat resistant alloy. If C content is 0.02% or less, the desired tensile strength and creep rupture strength can not be obtained. On the other hand, if the C content exceeds 0.1%, ductility and toughness of the resultant alloy are fairly reduced. The C content is therefore restricted in a range of from more than 0.02% but not more than 0.10%.

Si: not more than 1.0%

Si is necessary to deoxidize the alloy and serves to improve oxidation resistance of the resultant alloy as well. If Si content exceeds 1.0%, weldability and stability of strength of the alloy are reduced. The Si content is therefore restricted in a range not more than 1.0%.

Mn: not more than 2.0%

Mn is effective to deoxidize the alloy. However, more than 2.0% Mn content worsens heat resistant properties of the resultant alloy. Accordingly, the Mn content is restricted in a range of not more than 2.0%.

Cr: 28 to 38%

Cr improves high temperature corrosion resistance, oxidation resistance and particularly steam oxidation resistance of the alloy, and furthermore forms α-Cr phase which increases high temperature strength of the alloy. If Cr content is less than 28%, the desired level of the above-mentioned effects cannot be obtained. Cr content exceeding 38% causes reduction of workability and makes the structure of the resultant alloy unstable.

Ni: 35 to 60%

Ni is an indispensable element in producing a stable austenitic structure of the alloy. Ni, however, suppresses the precipitation of α-Cr phase. If Ni content is less than 35%, the stable austenitic structure cannot be obtained. Whereas a Ni content of more than 60% excessively suppresses the precipitation of α-Cr phase, and reduces high temperature strength. In addition, too much Ni makes the alloy expensive. The Ni content is therefore defined in a range of 35 to 60%.

Ti: from more than 0.5% to 1.5%

Ti accelerates precipitation of α-Cr phase which effectively increases strength at elevated temperatures. In order to get the desired amount of α-Cr phase precipitation which is necessary for sufficient high temperature strength, the Ti content must exceed 0.5%. On the other hand, if the Ti content exceeds 1.5%, too much α-Cr phase will precipitate, which will shorten the working life of the alloy due to reduction of rupture ductility and the lower ductility of the alloy after aging or after being used for a long time.

N: not more than 0.05%

N improves strength at elevated temperatures and stabilizes austenitic structure of the alloy. Accordingly, part of the expensive Ni can be effectively replaced with N. However, if N content exceeds 0.05%, nitrides begin to precipitate after being subjected to a high temperature during a long period of use, thus resulting in reduction of toughness. Accordingly, the N content is defined not to exceed 0.05%.

Al: 0.01 to 0.3%

Al is effective to deoxidize the alloy. In order to exhibit the functions of Al, the alloy should contain more than 0.01% Al. On the other hand, more than 0.3% of Al in the alloy worsens its workability. The Al content is therefore restricted in a range of 0.01 to 0.3%.

B: 0.001 to 0.01%

B effectively improves creep rupture strength of the alloy. Addition of B to the alloy accelerates precipitation of fine carbides and keeps the precipitated fine carbides stable. The precipitated carbides remarkably improve the strength of the alloy at high temperatures, suppress the grain growth of α-Cr phase and prevent the coarsening of the α-Cr phase after a long period of use. If B content is less than 0.001%, the above-mentioned advantageous effects cannot be obtained. On the other hand, if the B content exceeds 0.01%, both creep rupture strength and weldability of the alloy are lowered. The B content is therefore limited in a range of 0.001 to 0.01%.

Mo: 0.5 to 3.0%, W: 1.0 to 6.0%

Both Mo and W dissolve in an austenite matrix and increase strength, especially creep rupture strength. If Mo content is less than 0.5% or W content is less than 1.0%, the above-mentioned advantageous effects cannot be obtained. On the other hand, if the Mo content exceeds 3.0% or the W content exceeds 6.0%, both corrosion resistance and workability are diminished. Therefore, the Mo content is restricted in a range of 0.5 to 3.0% and the W content is restricted in a range of 1.0 to 6.0%. Either Mo or W, or both of them can be used. When both Mo and W are used, the sum of Mo content and half of W content (Mo+½·W) is preferably not more than 3.0%.

The austenitic alloy of this invention can contain the following optional elements.

Zr: 0 to 0.1%

Zr strengthens mainly the grain boundary of the austenitic alloy and improves creep rupture strength. In order to exhibit these effects, Zr content is preferably more than 0.01%. On the other hand, if the Zr content exceeds 0.1%, the creep rupture strength and weldability of the steel are lowered. The Zr content is therefore restricted in a range not exceeding 0.1%.

Nb: 0 to 1.0%

Nb produces fine crystal grains and increases ductility of the alloy. Nb also increases the creep rupture strength by dissolving in an austenite phase and in Cr carbide in a form of solid solution. In order to exhibit these effects, Nb content is preferably more than 0.10%. On the other hand, if the Nb content exceeds 1.0%, toughness of the steel is diminished. The Nb content is therefore restricted in a range not exceeding 1.0%.

Mg: 0.001 to 0.05%, Ca: 0.001 to 0.05%

Both Mg and Ca are effective to improve workability of the alloy. Less than 0.001% of Mg or Ca can not produce these effects on the steel. On the other hand, if the alloy contains more than 0.05% of each element, the workability of the alloy is worsened. The alloy can contain either Mg or Ca, or both of them. When the alloy contains both Mg and Ca, the sum is preferably in a range of 0.001 to 0.05%.

P and S are inevitably contained in the alloy as incidental impurities. In order to ensure excellent weldability and strength of the alloy at elevated temperatures, P content and S content should be restricted below 0.03% and 0.01%, respectively.

EXAMPLES

A series of alloys according to this invention, alloys Nos. 1 to 44, as shown in Tables 1 and 2, and another series of alloys of comparative examples, alloys marked A to W, as shown in Table 3, were melted in a high frequency vacuum melting furnace and then cast into ingots, each having 20 Kg weight. Each of the ingots was hot-forged, cold-rolled and subjected to a solution treatment at temperatures of 1200° C. From each of the resultant alloy billets, test specimens were prepared, which were then subjected to a. creep rupture test. The Charpy Impact Test was later conducted on specimens after they were subjected to an aging treatment.

The creep rupture tests were carried out using test specimen bars having an outer diameter of 6 mm and gage length of 30 mm at 700° C. The Charpy Impact Test was carried out using V-notched test specimens having a size of 5 mm thickness, 10 mm width, 55 mm length and 2 mm V-notch, that had been aged at 700° C. for 100 hours.

Creep rupture strength of $10^3$ hours and $10^4$ hours at 700° C., and the Charpy Impact values of the specimens after aging are shown in Tables 2, 5 and 6, wherein the alloys according to this invention are marked with Nos. 1 to 44, and the alloys of comparative examples are marked with A to W. The alloys marked with A to E have the compositions disclosed in JPPD 61-174350, and those marked with F and G have the compositions disclosed JPPD 61-276948.

TABLE 1

| | Alloy | Chemical Composition (Wt %, bal.: Fe and Incidental Impurities) | | | | | | | | | | | | | | |
|---|---|---|---|---|---|---|---|---|---|---|---|---|---|---|---|---|
| | No. | C | Si | Mn | Cr | Ni | Mo | W | Ti | B | Al | N | Zr | Nb | Mg | Ca |
| Examples of This Invention | 1 | 0.048 | 0.14 | 0.33 | 29.22 | 36.13 | 2.10 | — | 0.77 | 0.0048 | 0.017 | 0.027 | 0.042 | — | 0.0048 | — |
| | 2 | 0.056 | 0.32 | 1.24 | 31.49 | 35.29 | 1.17 | 2.82 | 0.75 | 0.0047 | 0.016 | 0.046 | 0.072 | — | — | — |
| | 3 | 0.073 | 0.31 | 0.42 | 31.24 | 38.80 | 0.78 | — | 0.72 | 0.0033 | 0.037 | 0.018 | — | — | — | — |
| | 4 | 0.060 | 0.28 | 0.21 | 30.81 | 40.77 | — | 4.15 | 0.77 | 0.0037 | 0.018 | 0.028 | 0.015 | — | — | — |
| | 5 | 0.043 | 0.17 | 0.12 | 30.14 | 40.83 | 2.09 | — | 0.74 | 0.0049 | 0.022 | 0.017 | 0.039 | 0.45 | 0.0090 | — |
| | 6 | 0.059 | 0.25 | 0.31 | 30.04 | 45.62 | 2.21 | — | 0.58 | 0.0048 | 0.045 | 0.022 | 0.030 | — | — | — |
| | 7 | 0.042 | 0.29 | 0.27 | 30.69 | 44.85 | 1.56 | 2.30 | 0.80 | 0.0072 | 0.021 | 0.018 | 0.044 | — | 0.0061 | — |
| | 8 | 0.061 | 0.11 | 0.79 | 30.28 | 45.31 | 0.95 | — | 0.78 | 0.0048 | 0.015 | 0.036 | — | — | 0.0053 | 0.0075 |
| | 9 | 0.065 | 0.30 | 0.36 | 29.87 | 44.99 | 1.94 | — | 0.74 | 0.0061 | 0.032 | 0.009 | 0.035 | — | — | — |
| | 10 | 0.068 | 0.27 | 0.24 | 29.70 | 44.78 | 2.67 | — | 0.92 | 0.0055 | 0.042 | 0.020 | 0.049 | — | — | — |
| | 11 | 0.072 | 0.22 | 0.27 | 30.15 | 45.16 | — | 5.22 | 1.25 | 0.0019 | 0.032 | 0.031 | 0.068 | — | — | — |
| | 12 | 0.066 | 0.29 | 0.15 | 30.33 | 45.02 | 2.14 | — | 1.40 | 0.0034 | 0.021 | 0.015 | — | — | — | — |
| | 13 | 0.048 | 0.37 | 0.18 | 30.23 | 45.25 | 1.23 | 2.40 | 0.89 | 0.0039 | 0.016 | 0.025 | 0.040 | 0.63 | — | — |
| | 14 | 0.053 | 0.20 | 0.21 | 30.17 | 48.95 | 1.41 | 2.84 | 0.62 | 0.0058 | 0.024 | 0.008 | 0.092 | — | 0.0124 | — |
| | 15 | 0.052 | 0.19 | 0.27 | 30.01 | 50.54 | 2.13 | — | 0.73 | 0.0049 | 0.038 | 0.020 | 0.037 | — | — | — |
| | 16 | 0.065 | 0.23 | 1.60 | 29.84 | 54.78 | 2.36 | — | 0.95 | 0.0031 | 0.041 | 0.015 | 0.035 | 0.82 | — | — |
| | 17 | 0.069 | 0.32 | 0.24 | 30.12 | 58.55 | — | 1.95 | 0.76 | 0.0040 | 0.026 | 0.028 | — | — | — | 0.0043 |
| | 18 | 0.046 | 0.31 | 0.21 | 34.59 | 37.87 | 2.85 | — | 0.80 | 0.0023 | 0.022 | 0.019 | 0.082 | — | — | — |
| | 19 | 0.052 | 0.20 | 0.15 | 35.20 | 40.90 | 2.13 | — | 0.79 | 0.0050 | 0.036 | 0.025 | — | — | — | — |
| | 20 | 0.025 | 0.29 | 0.21 | 35.51 | 40.25 | 1.37 | 2.95 | 1.04 | 0.0051 | 0.043 | 0.021 | 0.045 | — | — | — |
| | 21 | 0.056 | 0.25 | 0.21 | 34.91 | 45.03 | 2.83 | — | 0.74 | 0.0062 | 0.018 | 0.028 | 0.063 | — | — | — |
| | 22 | 0.063 | 0.30 | 0.18 | 34.19 | 44.29 | 1.74 | — | 0.77 | 0.0038 | 0.045 | 0.026 | 0.056 | — | 0.0062 | 0.0073 |
| | 23 | 0.056 | 0.32 | 0.24 | 35.36 | 45.26 | — | 1.51 | 0.83 | 0.0052 | 0.012 | 0.028 | 0.038 | 0.34 | — | — |
| | 24 | 0.046 | 0.29 | 0.24 | 35.39 | 47.43 | 0.82 | — | 0.71 | 0.0047 | 0.019 | 0.025 | — | — | — | — |
| | 25 | 0.051 | 0.22 | 0.28 | 34.85 | 49.56 | 1.91 | — | 1.34 | 0.0054 | 0.032 | 0.023 | 0.037 | — | 0.0021 | — |

TABLE 2

| | Alloy | Chemical Composition (Wt %. bal.: Fe and Incidental Impurities) | | | | | | | | | | | | | | |
|---|---|---|---|---|---|---|---|---|---|---|---|---|---|---|---|---|
| | No. | C | Si | Mn | Cr | Ni | Mo | W | Ti | B | Al | N | Zr | Nb | Mg | Ca |
| Examples of This Invention | 26 | 0.027 | 0.89 | 0.15 | 35.23 | 50.02 | — | 5.10 | 0.82 | 0.0073 | 0.018 | 0.021 | 0.041 | — | — | — |
| | 27 | 0.056 | 0.26 | 0.24 | 35.62 | 51.51 | 1.12 | 3.18 | 0.58 | 0.0035 | 0.011 | 0.023 | 0.027 | — | — | — |
| | 28 | 0.060 | 0.31 | 0.18 | 35.16 | 55.19 | 2.08 | — | 0.63 | 0.0016 | 0.034 | 0.015 | 0.028 | — | — | — |
| | 29 | 0.062 | 0.26 | 0.19 | 34.11 | 55.28 | 2.05 | — | 0.57 | 0.0033 | 0.028 | 0.020 | 0.031 | — | — | — |
| | 30 | 0.051 | 0.24 | 0.23 | 35.02 | 55.10 | 2.15 | — | 0.69 | 0.0054 | 0.027 | 0.017 | 0.027 | — | — | — |
| | 31 | 0.059 | 0.31 | 0.18 | 34.68 | 54.48 | 1.92 | — | 0.61 | 0.0075 | 0.024 | 0.018 | 0.036 | — | — | — |
| | 32 | 0.064 | 0.30 | 0.19 | 35.13 | 55.02 | 1.94 | — | 0.70 | 0.0094 | 0.022 | 0.021 | 0.034 | — | — | — |
| | 33 | 0.055 | 0.25 | 0.22 | 35.10 | 55.26 | 2.17 | — | 1.09 | 0.0016 | 0.029 | 0.019 | 0.031 | — | — | — |
| | 34 | 0.058 | 0.29 | 0.17 | 34.94 | 54.88 | 2.06 | — | 0.82 | 0.0030 | 0.032 | 0.017 | 0.029 | — | — | — |
| | 35 | 0.063 | 0.24 | 0.20 | 35.20 | 55.14 | 1.90 | — | 0.98 | 0.0049 | 0.030 | 0.022 | 0.026 | — | — | — |
| | 36 | 0.060 | 0.33 | 0.25 | 35.34 | 55.23 | 1.99 | — | 0.88 | 0.0070 | 0.025 | 0.025 | 0.030 | — | — | — |
| | 37 | 0.066 | 0.31 | 0.21 | 34.78 | 54.91 | 2.14 | — | 0.95 | 0.0089 | 0.033 | 0.020 | 0.033 | — | — | — |
| | 38 | 0.057 | 0.30 | 0.24 | 35.22 | 54.85 | 2.21 | — | 1.38 | 0.0019 | 0.025 | 0.024 | 0.035 | — | — | — |
| | 39 | 0.059 | 0.28 | 0.17 | 35.17 | 54.89 | 2.13 | — | 1.14 | 0.0033 | 0.028 | 0.017 | 0.031 | — | — | — |
| | 40 | 0.062 | 0.26 | 0.19 | 34.83 | 55.31 | 1.95 | — | 1.36 | 0.0049 | 0.031 | 0.019 | 0.029 | — | — | — |
| | 41 | 0.065 | 0.31 | 0.22 | 35.06 | 55.18 | 2.07 | — | 1.21 | 0.0073 | 0.033 | 0.025 | 0.035 | — | — | — |
| | 42 | 0.064 | 0.31 | 0.20 | 34.97 | 55.05 | 2.11 | — | 1.40 | 0.0091 | 0.029 | 0.023 | 0.028 | — | — | — |
| | 43 | 0.053 | 0.13 | 0.18 | 35.13 | 58.25 | 1.96 | — | 0.88 | 0.0051 | 0.020 | 0.018 | 0.030 | — | 0.0024 | — |
| | 44 | 0.053 | 0.24 | 0.27 | 35.17 | 57.98 | 1.14 | 3.01 | 0.75 | 0.0041 | 0.019 | 0.024 | — | 0.91 | 0.0050 | — |

TABLE 3

| | Alloy | Chemical Composition (Wt %. Bal.: Fe and Incidental Impurities) | | | | | | | | | | | | | | |
|---|---|---|---|---|---|---|---|---|---|---|---|---|---|---|---|---|
| | No. | C | Si | Mn | Cr | Ni | Mo | W | Ti | B | Al | N | Zr | Nb | Mg | Ca |
| Comparative Examples | A | 0.047 | 0.29 | 0.25 | 30.23 | 45.51 | 2.69 | — | 0.45 | — | 0.034 | 0.035 | 0.034 | — | — | — |
| | B | 0.056 | 0.28 | 0.27 | 30.45 | 49.98 | 2.05 | — | 0.30 | 0.0056 | 0.039 | 0.023 | 0.040 | — | — | — |
| | C | 0.060 | 0.27 | 0.24 | 34.50 | 40.16 | 1.07 | 1.36 | 0.36 | — | 0.026 | 0.025 | 0.041 | — | — | — |
| | D | 0.051 | 0.15 | 0.29 | 34.11 | 45.26 | — | 2.64 | 0.29 | 0.0065 | 0.028 | 0.022 | 0.035 | — | — | — |
| | E | 0.044 | 0.27 | 0.24 | 34.24 | 49.97 | 0.74 | 0.86 | 0.25 | 0.0062 | 0.040 | 0.018 | 0.034 | — | — | — |
| | F | 0.056 | 0.31 | 0.28 | 30.35 | 50.09 | 1.90 | — | 0.52 | — | 0.020 | 0.025 | 0.054 | — | — | — |
| | G | 0.059 | 0.25 | 0.14 | 34.13 | 50.49 | 2.04 | — | 0.70 | — | 0.030 | 0.028 | 0.031 | — | — | — |
| | H | 0.022 | 0.27 | 0.24 | 35.46 | 40.31 | — | — | 0.55 | — | 0.036 | 0.027 | 0.030 | — | — | — |
| | I | 0.052 | 0.08 | 0.15 | 35.20 | 45.62 | — | — | 0.71 | 0.0007 | 0.040 | 0.020 | 0.034 | — | — | — |
| | J | 0.066 | 0.31 | 0.22 | 35.03 | 44.85 | 2.84 | — | 1.02 | 0.0004 | 0.034 | 0.025 | 0.032 | — | — | — |
| | K | 0.058 | 0.29 | 0.23 | 34.56 | 44.88 | 2.76 | — | 1.40 | 0.0005 | 0.031 | 0.019 | 0.029 | — | — | — |
| | L | 0.062 | 0.30 | 0.22 | 34.88 | 55.16 | 1.90 | — | 1.61 | 0.0007 | 0.033 | 0.019 | 0.035 | — | — | — |
| | M | 0.059 | 0.25 | 0.21 | 35.03 | 54.86 | 2.04 | — | 0.40 | 0.0021 | 0.035 | 0.017 | 0.028 | — | — | — |
| | N | 0.058 | 0.29 | 0.19 | 35.15 | 55.20 | 2.12 | — | 0.45 | 0.0042 | 0.029 | 0.020 | 0.031 | — | — | — |
| | O | 0.063 | 0.31 | 0.23 | 35.19 | 55.13 | 2.08 | — | 0.32 | 0.0072 | 0.031 | 0.023 | 0.033 | — | — | — |
| | P | 0.060 | 0.33 | 0.20 | 34.96 | 55.25 | 1.95 | — | 0.36 | 0.0102 | 0.030 | 0.022 | 0.030 | — | — | — |
| | Q | 0.061 | 0.28 | 0.20 | 34.89 | 54.90 | 1.99 | — | 1.58 | 0.0026 | 0.034 | 0.018 | 0.027 | — | — | — |
| | R | 0.057 | 0.27 | 0.18 | 35.22 | 54.95 | 2.05 | — | 1.62 | 0.0050 | 0.027 | 0.023 | 0.031 | — | — | — |
| | S | 0.059 | 0.32 | 0.24 | 35.28 | 55.17 | 1.97 | — | 1.58 | 0.0074 | 0.032 | 0.016 | 0.034 | — | — | — |
| | T | 0.062 | 0.31 | 0.23 | 35.10 | 55.03 | 2.12 | — | 0.62 | 0.0108 | 0.031 | 0.024 | 0.035 | — | — | — |
| | U | 0.064 | 0.30 | 0.25 | 34.97 | 55.18 | 2.14 | — | 0.99 | 0.0107 | 0.035 | 0.018 | 0.028 | — | — | — |
| | V | 0.065 | 0.33 | 0.21 | 35.08 | 54.89 | 2.09 | — | 1.28 | 0.0105 | 0.028 | 0.020 | 0.032 | — | — | — |
| | W | 0.058 | 0.26 | 0.22 | 34.85 | 54.82 | 2.01 | — | 1.55 | 0.0108 | 0.030 | 0.023 | 0.034 | — | — | — |

TABLE 5

| | Alloy | Creep Rupture Strength at 700° C. (kgf/mm²) | | Impact Value after Aging |
|---|---|---|---|---|
| | No. | 1000 h | 10000 h | (kgf-m/cm²) |
| Examples of This Invention | 26 | 17.1 | 13.7 | 14.2 |
| | 27 | 17.4 | 14.2 | 15.4 |
| | 28 | 16.9 | 13.7 | 15.5 |
| | 29 | 17.2 | 13.9 | 15.4 |
| | 30 | 17.5 | 14.1 | 14.8 |
| | 31 | 17.2 | 13.9 | 14.5 |
| | 32 | 16.8 | 13.4 | 13.7 |
| | 33 | 17.3 | 13.9 | 14.2 |
| | 34 | 18.1 | 14.8 | 13.5 |
| | 35 | 18.0 | 14.6 | 13.2 |
| | 36 | 17.5 | 14.3 | 14.6 |
| | 37 | 16.9 | 13.5 | 14.2 |
| | 38 | 16.8 | 13.5 | 13.5 |
| | 39 | 17.8 | 14.5 | 13.8 |
| | 40 | 17.1 | 13.7 | 14.0 |
| | 41 | 17.3 | 14.1 | 14.2 |
| | 42 | 16.6 | 13.2 | 13.3 |
| | 43 | 17.1 | 13.7 | 14.4 |
| | 44 | 17.3 | 13.6 | 14.3 |

TABLE 4

| | Alloy | Creep Rupture Strength at 700° C. (kgf/mm²) | | Impact Value after Aging |
|---|---|---|---|---|
| | No. | 1000 h | 10000 h | (kgf-m/cm²) |
| Examples of This Invention | 1 | 16.5 | 13.1 | 15.6 |
| | 2 | 16.9 | 13.7 | 14.2 |
| | 3 | 17.3 | 13.9 | 14.7 |
| | 4 | 17.1 | 13.4 | 14.5 |
| | 5 | 17.4 | 14.0 | 14.3 |
| | 6 | 17.5 | 14.3 | 15.1 |
| | 7 | 17.5 | 13.9 | 14.9 |
| | 8 | 17.4 | 14.0 | 14.2 |
| | 9 | 17.7 | 14.4 | 14.6 |
| | 10 | 16.8 | 13.4 | 14.5 |

TABLE 4-continued

| | Alloy | Creep Rupture Strength at 700° C. (kgf/mm²) | | Impact Value after Aging |
|---|---|---|---|---|
| | No. | 1000 h | 10000 h | (kgf-m/cm²) |
| | 11 | 17.3 | 13.9 | 14.0 |
| | 12 | 16.7 | 13.5 | 14.3 |
| | 13 | 17.9 | 14.5 | 14.8 |
| | 14 | 18.1 | 14.8 | 14.1 |
| | 15 | 17.7 | 14.2 | 14.3 |
| | 16 | 17.6 | 14.0 | 13.9 |
| | 17 | 17.3 | 13.9 | 14.4 |
| | 18 | 17.5 | 14.1 | 14.9 |
| | 19 | 16.8 | 13.6 | 14.7 |
| | 20 | 17.4 | 14.2 | 14.6 |
| | 21 | 17.3 | 13.8 | 14.3 |
| | 22 | 17.1 | 13.7 | 14.6 |
| | 23 | 18.0 | 14.6 | 14.5 |
| | 24 | 17.8 | 14.2 | 14.4 |
| | 25 | 17.2 | 14.1 | 14.3 |

TABLE 6

| | Alloy | Creep Rupture Strength at 700° C. (kgf/mm²) | | Impact Value after Aging |
|---|---|---|---|---|
| | No. | 1000 h | 10000 h | (kgf-m/cm²) |
| Comparative Examples | A | 13.5 | 10.0 | 15.1 |
| | B | 14.8 | 11.3 | 14.3 |
| | C | 13.2 | 9.8 | 14.9 |
| | D | 14.7 | 11.3 | 14.2 |
| | E | 15.1 | 11.8 | 13.8 |
| | F | 14.1 | 10.7 | 15.0 |
| | G | 14.9 | 11.2 | 13.2 |
| | H | 14.2 | 10.7 | 16.4 |
| | I | 15.9 | 12.5 | 14.8 |
| | J | 16.1 | 12.6 | 14.2 |
| | K | 15.3 | 11.7 | 12.4 |
| | L | 15.0 | 11.4 | 10.5 |
| | M | 16.2 | 12.7 | 16.2 |
| | N | 16.1 | 12.8 | 16.0 |

TABLE 6-continued

| Alloy No. | Creep Rupture Strength at 700° C. (kgf/mm$^2$) 1000 h | 10000 h | Impact Value after Aging (kgf-m/cm$^2$) |
|---|---|---|---|
| O | 15.4 | 12.0 | 15.4 |
| P | 15.2 | 11.7 | 15.7 |
| Q | 15.1 | 11.7 | 11.1 |
| R | 15.2 | 11.6 | 10.2 |
| S | 14.6 | 11.2 | 10.5 |
| T | 15.1 | 11.8 | 14.8 |
| U | 14.8 | 11.4 | 14.1 |
| V | 14.8 | 11.3 | 12.6 |
| W | 14.3 | 10.6 | 9.8 |

FIG. 1 shows the influence of both Ti content and B content on creep rupture strength of the tested alloys. It is apparent from FIG. 1 that the alloys of this invention have excellent creep rupture strength. It is also apparent from Tables 4 to 6 that the toughness of the alloys of this invention is comparable with that of conventional alloys.

As shown in the Tables 4 to 6, the alloys of this invention containing Ti in amounts from more than 0.5% to 1.5% have a much higher creep rupture strength than the comparative example alloys A to E which contain less than 0.5% Ti. The alloys of this invention also have a higher creep rupture strength than the comparative example alloys F and G containing Ti but not containing B. This is caused by the fact that Ti accelerated precipitation of α-Cr phase while B accelerates precipitation of fine carbides and stabilizes them, resulting in an improvement of the high temperature strength. The fine carbides suppresses grain growth and coarsening of the α-Cr phase after being subjected to actual working conditions for long periods of time.

As mentioned above, the high Cr austenitic heat resistant alloy of this invention has excellent high temperature strength and can be used for producing a single layered tube, which is less expensive and more reliable than using the conventional double layered tube.

Although this invention has been described with respect to a preferred embodiment thereof, it should be understood by those skilled in the art that various changes and modifications may be made without departing from the spirit and scope of the invention.

What is claimed is:

1. A heat resistant high chromium austenitic alloy excellent in high temperature strength consisting essentially of, in weight percent, from more than 0.02% to 0.10% C, not more than 1.0% Si, not more than 2.0% Mn, 28 to 38% Cr, 35 to 60% Ni, from more than 0.5% to 1.5% Ti, not more than 0.05% N, 0.01 to 0.3% Al, 0.001 to 0.01% B, 0 to 0.1% Zr, 0 to 1.0% Nb, one or both of 0.5 to 3.0% Mo and 1.0 to 6.0% W, and 0.001 to 0.05% Ca, and the balance being Fe and incidental impurities.

2. A heat resistant high chromium austenitic alloy according to claim 1, wherein Zr content is 0.01 to 0.1% and Nb content is 0.10 to 1.0%, in weight percent, respectively.

3. A heat resistant high chromium austenitic alloy according to claim 1, further comprising 0.001 to 0.05% Mg.

4. A heat resistant high chromium austenitic alloy according to claim 1, having a creep rupture strength at 700° C. after 1000 hours of at least 16.5 kgf/mm$^2$.

5. A heat resistant high chromium austenitic alloy according to claim 1, having a creep rupture strength at 700° C. after 10000 hours of at least 13.1 kgf/mm$^2$.

6. A heat resistant high chromium austenitic alloy according to claim 1, having an impact value after aging at 700° C. for 100 hours of at least 13.3 kgf-m/cm$^2$.

7. A heat resistant high chromium austenitic alloy according to claim 1, having Ti in an amount sufficient to accelerate precipitation of Cr-rich body centered cubic α-Cr phase and B in an amount sufficient to accelerate precipitation of fine carbides which suppress grain growth and coarsening of the α-Cr phase during long exposures to elevated temperatures.

* * * * *